US008600251B2

(12) United States Patent
Ogata et al.

(10) Patent No.: US 8,600,251 B2
(45) Date of Patent: Dec. 3, 2013

(54) IMAGE FORMING APPARATUS AND IMAGE FORMING METHOD

(75) Inventors: Satoshi Ogata, Hachioji (JP); Katsunori Takahashi, Hachioji (JP); Jun Onishi, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 330 days.

(21) Appl. No.: 13/114,747

(22) Filed: May 24, 2011

(65) Prior Publication Data

US 2011/0293307 A1 Dec. 1, 2011

(30) Foreign Application Priority Data

May 27, 2010 (JP) ..... 2010-121472

(51) Int. Cl.
*G03G 15/16* (2006.01)
*G03G 15/08* (2006.01)

(52) U.S. Cl.
USPC ..... 399/66; 399/121

(58) Field of Classification Search
USPC ..... 399/66, 121
See application file for complete search history.

(56) References Cited

U.S. PATENT DOCUMENTS 6,185,402 B1 * 2/2001 Linssen ..... 399/301

FOREIGN PATENT DOCUMENTS

| | | | |
|---|---|---|---|
| JP | 01209456 A | * | 8/1989 |
| JP | 2008-304552 | | 12/2008 |
| JP | 2009-9103 | | 1/2009 |

* cited by examiner

*Primary Examiner* — Walter L Lindsay, Jr.
*Assistant Examiner* — Erika J Villaluna
(74) *Attorney, Agent, or Firm* — Finnegan, Henderson, Farabow, Garrett & Dunner, LLP

(57) ABSTRACT

An image forming apparatus including: an image bearing member for bearing a toner image; a transfer section, which is pressed against, and is separated from, the image bearing member, for transferring a toner image on the image bearing member onto a recording medium when being pressed against the image bearing member, a transfer section drive section for driving the transfer section to rotate; and a control section configured to control the transfer section drive section to carry out constant speed control and constant torque control, to drive said transfer section to rotate at a constant speed, and at a constant torque, respectively, wherein the control section carries out the constant torque control while the transfer section is pressed against the image bearing member, in accordance with a drive torque detected when the constant speed control is carried out while the transfer section is separated from the image bearing member.

14 Claims, 4 Drawing Sheets

IMAGE FORMING APPARATUS AND IMAGE FORMING METHOD

This application is based on Japanese Patent Application No. 2010-121472 filed on May 27, 2010 with the Japanese Patent Office, the entire content of which is hereby incorporated by reference.

TECHNICAL FIELD

The present invention relates to an image forming apparatus and image forming method in which a transfer section is pressed into contact with an image bearing member that bears a toner image thereon, and the toner image on the image bearing member is transferred onto a recording medium via passing the recording medium between the image bearing member and the transfer section.

BACKGROUND OF THE INVENTION

In an image forming apparatus such as a printer, a facsimile, a copy machine, a multi-functional peripheral, or the like, in which an image is formed based on image data and is transferred onto a recording sheet, a latent image is formed on a photoconductor based on image data, and the latent image is developed with a developer, and the developed image is transferred directly, or via an intermediate transfer section, onto a recording sheet. During the transfer, the above-mentioned developed image is transferred onto a recording sheet by pressing a transfer section, which includes a transfer roller, a transfer belt, or the like, into contact with an image bearing member such as the above-mentioned photoconductor or intermediate transfer section, and passing the recording sheet between the part of pressure contact (also referred to as a transfer nip portion).

The above-mentioned transfer section can be driven to rotate by an image bearing member by pressing the transfer section into contact with the image bearing member, which is driven to rotate. However, it becomes difficult for the transfer section to be driven in cases in which a load is given onto the transfer section, and therefore, there are cases in which a transfer section drive section, which drives the transfer section to rotate, becomes necessary. As an example, in cases in which an inter-paper patch correction, or the like, for improving productivity, is carried out, it is necessary to do so while the transfer section is pressed into contact with the image bearing member. Therefore, in this case, a toner attached on the inter-paper patch adheres onto the transfer section. Image forming apparatuses, which are equipped with a cleaning member for transfer section in order to remove the toner adhered onto the image bearing member, have been suggested. The cleaning member, which is a blade, or the like, in general, is pressed into contact with the surface of the transfer section such as a transfer roller, a transfer belt, or the like. Therefore, a load is given onto the transfer section due to the contact of the cleaning member under pressure. In cases of image forming apparatuses equipped with a transfer section cleaning section, because it is difficult for a transfer section to be driven by an image bearing member as described above, a transfer section drive section to drive the transfer section is equipped (for examples, refer to Unexamined Japanese Patent Application No. 2008-304552 and No. 2009-9103).

As just described, in cases in which an image bearing member and a transfer section is to be driven to rotate individually, it is necessary not to deteriorate the accuracy of image forming by the effect of the rotation of transfer section on the rotation of image bearing member. In Unexamined Japanese Patent Application No. 2008-304552, the load onto the image bearing member, due to the rotation of transfer section, is reduced by controlling the driving power, given to the transfer section, in accordance with at least either one of the usage history of cleaning member or the amount of water in the air. In Unexamined Japanese Patent Application No. 2009-9103, by detecting a torque command value of the intermediate transfer section, the control of intermediate transfer section is prevented from being broken down by changing the speed of the transfer section when that command value exceeds a lower limit.

Further, as disclosed in Unexamined Japanese Patent Application No. 2008-304552, the torque given to an image bearing member is kept constant regardless of existence or non-existence of a sheet at a transfer section, by a) providing a torque limiter to the drive system of the transfer section, b) setting the limiter value to "the load of the transfer section (mainly, load from cleaning member)+$\alpha$", c) setting the transfer section to rotate a little faster than the image bearing member so that the transfer section presses the image bearing member slightly (namely, torque of "+$\alpha$": the value of $\alpha$ is in a range of values with which the total load (the load of the transfer section+$\alpha$) does not become less than the original load without a even if the original load is reduced by a fluctuation due to periodic speed fluctuation, or the like) in the state in which the transfer section is pressed into contact, and d) activating the torque limiter in that state in which the transfer section presses the image bearing member slightly.

However, as shown in FIG. 6, in cases in which transfer section 30 is driven to rotate by being pressed into contact with image bearing member 31 (in this case, an intermediate transfer belt), if sheet P is passed through the part of pressure contact, the radius of rotation of transfer section 30 is changed by the thickness of sheet P. Therefore, when transfer section 30 is controlled so as to rotate at a constant speed, the torque given to image bearing member 31 varies by the passage cycle of sheet P, and as a result, the speed of image bearing member 31 is changed and color deviation, or the like, occurs, resulting in the problem that the accuracy of image formation deteriorates. In the above-mentioned Unexamined Japanese Patent Application No. 2008-304552, although it is aimed to reduce the fluctuation of torque to the image bearing member, the degree of accuracy is low and it is difficult to solve the fluctuation of torque sufficiently. Also, in Unexamined Japanese Patent Application No. 2009-9103, it is difficult to obtain the derived effect of reducing fluctuation in delivery of torque between the transfer section and image bearing member, thus, the above-mentioned problem is be solved.

Further, in a method in which a torque limiter is used, when the fluctuation (chronological/environmental) of the load (mainly from a cleaning member) of transfer section 30 is large, there is a problem that a limiter value cannot be set. More specifically, in cases in which the load becomes heavier and exceeds the limiter value, the driving at the transfer section side always runs idle, and therefore, cannot drive at a predetermined speed. In cases in which the load becomes too low, the transfer section pushes the image bearing member until the limiter value, resulting in the situation, which is the problem to be solved in Unexamined Japanese Patent Application No. 2009-9103, in which the load onto the image bearing member becomes too low (becoming a minus load in extreme case), and resulting in failure of the control or occurrence of significant color deviation in image forming.

SUMMARY OF THE INVENTION

The present invention has been achieved in consideration of the above-stated problems, and to provide an image forming apparatus and an image forming method in which the accuracy of image forming can be maintained successfully without posing unnecessary load fluctuation onto an image bearing member in a configuration in which a transfer section is driven to rotate.

To achieve at least one of the above-mentioned objects, an image forming apparatus reflecting one aspect of the present invention including: an image bearing member for bearing a toner image; a transfer section, being pressed into contact with or being separated from the image bearing member, for transferring a toner image borne on the image bearing member onto a recording medium at the time of being pressed into contact with the image bearing member; a transfer section drive section for driving the transfer section to rotate; and a control section configured to control the transfer section drive section to carry out a constant speed control, to drive the transfer section to rotate at a constant speed, and a constant torque control, to drive the transfer section to rotate at a constant torque, wherein the control section carries out the constant torque control under a state in which the transfer section is pressed into contact with the image bearing member, in accordance with a drive torque under constant speed, the drive torque that is detected when the constant speed control is carried out in a state in which the transfer section is separated from the image bearing member.

To achieve at least one of the above-mentioned objects, an image forming method reflecting one aspect of the present invention including the steps of: a) detecting drive torque, in a state in which a transfer section, which is pressed into contact with an image bearing member which bears a toner image, and is being separated from the image bearing member, is separated from the image bearing member, while controlling a drive section, which drives the transfer section to rotate, to carry out a constant speed control to drive the transfer section to rotate at a constant speed; b) carrying out constant torque control in a state in which the transfer section is pressed into contact with the image bearing member under pressure, in accordance with the drive torque.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

Figure 1A:
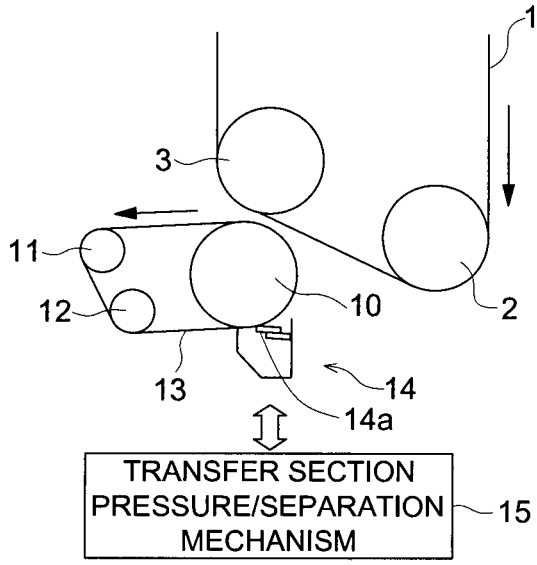
FIGS. 1*a* and 1*b* each is a diagram schematically showing a configuration of the periphery of a transfer section according to an embodiment of the present invention.
Figure 1B:
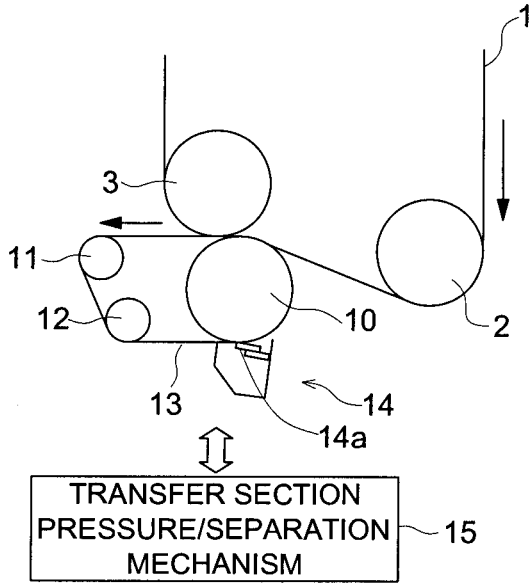

Now, preferred embodiments of the present invention will be described with reference to the accompanying drawings, without the present invention being limited to the embodiments. FIGS. 1*a* and 1*b* each is a diagram schematically showing the periphery of a transfer section of an image forming apparatus. Intermediate transfer belt 1, which is an image bearing member, is in a shape of an endless belt, and wound around image bearing member drive roller 2, image bearing member driven roller 3, and other driven rollers which are not shown in the figure. Transfer roller 10, which is a transfer section, is disposed adjacent to the above-mentioned intermediate transfer belt 1. Around transfer roller 10, transfer section driving belt 13 is wound through transfer section drive roller 11 and transfer section driven roller 12. Also, cleaning blade 14*a*, of transfer section cleaning section 14, is abutted to transfer roller 10, whereby cleaning of the surface of transfer roller 10 can be done.

Further provided is transfer section pressure/separation mechanism 15 which moves transfer roller 11, transfer section drive roller 11, transfer section driven roller 12, transfer section driving belt 13, and transfer section cleaning section, as a package, so that transfer roller 10 is pressed into contact with it, and is separated from intermediate transfer belt 1. FIG. 1*a* shows a state in which transfer roller 10 is separated from intermediate transfer belt 1, and FIG. 1*b* shows a state in which transfer roller 10 is pressed into contact with intermediate transfer belt 1. As transfer section pressure/separation mechanism 15, known structures can be adopted, without the present invention being restricted by any particular structure.

Figure 2:
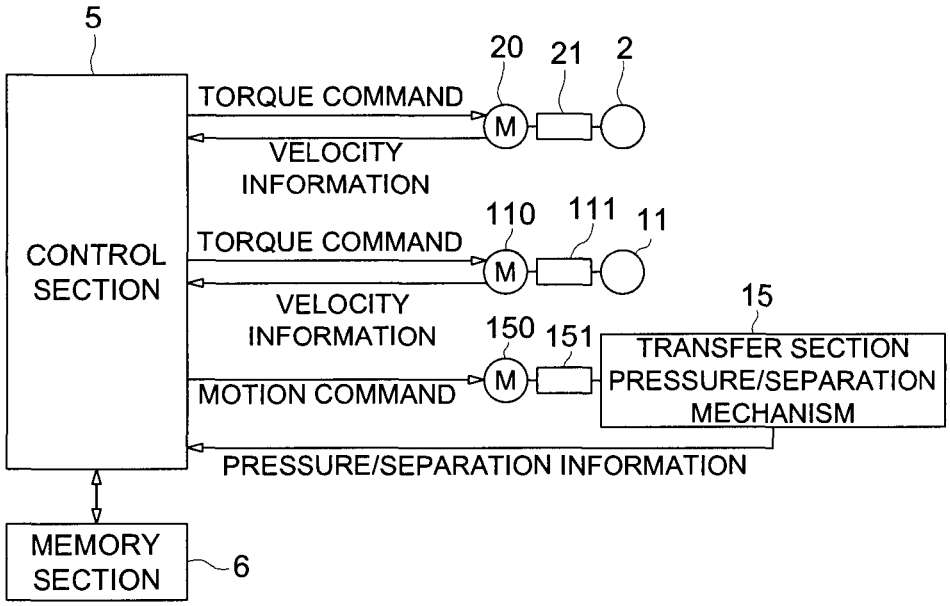
FIG. 2 is a circuit block diagram according to a control of a transfer section and an image bearing member according to an embodiment of the present invention.

FIG. 2 is a circuit block diagram related to a control of a transfer section and an image bearing member according to an embodiment of the present invention. Control section 5 controls drive motors which drive intermediate transfer belt 1, transfer roller 10, and transfer section pressure/separation mechanism 15, or the like, and is mainly composed of CPU and programs which makes the CPU operate. Memory section 6, which is composed of ROM, RAM, non-volatile memory, and the like, is connected to control section 5.

Image bearing member drive motor 20, which drives image bearing member drive roller 2 to rotate, which in turn rotates intermediate transfer belt 1, is connected, to be capable of being controlled, to control section 5. Image bearing member drive roller 2 is connected to a drive shaft of image bearing member drive motor 20 via image bearing member drive conveyance mechanism 21. Image bearing member drive motor 20 consists of a DC brushless motor, and corresponds to an image bearing member drive section in this embodiment of the present invention. At control section 5, a torque command value, which consists of PWM (Pulse Width Modulation) signal which controls speed and torque of image bearing member drive motor 20, is sent to image bearing member drive motor 20. Also, at image bearing member drive member 20, the rotation is detected via a rotation sensor, which is not shown in the figure, or the like, and the result of detection is fed back to control section 5 as velocity information. Note that a Hall element or other known devices can be used as a rotation sensor, without the present invention being restricted by any particular device.

Further, transfer section drive motor 110, which drives transfer section drive roller 11 to rotate, which in turn rotates transfer roller 10, is connected, to be capable of being controlled, to control section 5. Transfer section drive roller 11 is connected to a drive shaft of transfer section drive motor 110 via transfer section drive conveyance mechanism 111. Transfer section drive motor 110 consists of a DC brushless motor and corresponds to an image bearing member drive section in this embodiment of the present invention. Via control section 5, a torque command value, which consists of PWM signal which controls speed and torque of image bearing member drive motor 110, is sent to image bearing member drive motor 110. Also, at image bearing member driving member 110, the rotation is detected via a rotation sensor, which is not shown in the figure, or the like, and the result of detection is fed back to control section 5 as velocity information. Note that a Hall element or other known devices may be used as a rotation sensor, without the present invention being restricted by any particular device.

Further, transfer section pressure/separation motor 150 is connected, to be capable of being controlled, to control section 5. Transfer section pressure/separation mechanism 15 is connected to a drive shaft of transfer section pressure/separation motor 150 via transfer section pressure/separation conveyance mechanism 151. A transfer section pressure/separation means of an embodiment of the present invention consists of transfer section pressure/separation motor 150, transfer section pressure/separation conveyance mechanism 151, and transfer section pressure/separation mechanism 15. Via transfer section pressure/separation mechanism 15, pressure/separation is detected based on a sensor which detects the position of transfer roller, and the like, and the result of detection is sent to control section 5 as pressure/separation information. Via control section 5, a motion command value, which controls the pressure/separation operations of the above-mentioned transfer section pressure/separation means, is sent to transfer section pressure/separation motor 150.

Next, operation at the transfer section will now be described. Control section 5 controls to rotate intermediate transfer belt 1 at a constant speed of a predetermined speed in conjunction with image forming operations of the image forming apparatus. With regard to speed control of intermediate transfer belt 1, a torque command value, which consists of PWM signal, is sent to image bearing member drive motor 20 so as to obtain the above-mentioned predetermined speed, and this image bearing member drive roller 2 is rotated at a constant speed. Information, regarding the PWM signal with which the above-mentioned predetermined speed is obtained, is memorized in memory section 6 in advance, from which control section 5 reads out the above-mentioned information and generates the PWM signal.

Also, the rotation of image bearing member drive motor 20 is detected by a rotation sensor, which is not shown in the figure, and the detected result is fed back to control section 5 as velocity information. Control section 5 determines whether the speed is within the range of the predetermined speed, having been set, based on that velocity information. If the speed is within the set range, control section 5 maintains the above-mentioned torque command value. If it falls below the set range, control section 5 controls to drive image bearing member drive motor 20 by generating a PWM signal so as to have an increased torque command value. If it exceeds the set range, control section 5 controls to drive image bearing member drive motor 20 by generating a PWM signal so as to have a decreased torque command value to maintain the speed within the set range. In such a way, intermediate transfer belt 1 is controlled to rotate at a constant speed (constant speed control).

In the meantime, transfer roller 10 is controlled to rotate differently depending on whether transfer roller 10 is pressed into contact with or is separated from intermediate transfer belt 1. In a state in which transfer roller 10 is separated from intermediate transfer belt 1, transfer section pressure/separation motor 150 has operated before or just before, via control section 5, to separate transfer roller 10 from intermediate transfer belt 1. When control section 5 detects that transfer roller 10 is in the state of separation from intermediate transfer belt 1, control section 5 sends a torque command value to transfer section drive motor 110 by a PWM signal so as to obtain a predetermined speed, and controls to drive transfer section drive roller 11 at a constant speed. Information, regarding the PWM signal with which the above-mentioned predetermined speed is obtained, is memorized in memory section 6 in advance, and control section 5 reads out the above-mentioned information and generates the PWM signal. Regarding whether transfer roller 10 is in the state of pressure contact with or separation from intermediate transfer belt 1, it may be determined by using a sensor which detects the position of transfer roller 10 or the position of a member which moves together with transfer roller 10 in conjunction with the pressure/separation operations of transfer roller 10. By using the detected result of the sensor, control section 5 can determine whether transfer roller 10 is in the state of pressure contact with or separation from intermediate transfer belt 1.

In the meantime, the rotation of transfer section drive motor 110 is detected by a sensor, which is not shown in the figure, and the detected result is fed back to control section 5 as velocity information. In control section 5, it is determined whether or not the speed is within a specific speed range, having been set, based on the velocity information. If the speed is within the set speed range, control section 5 maintains the above-mentioned torque command value. If it falls below the set speed range, control section 5 controls to drive image bearing member drive motor 110 by generating a PWM signal so as to have an increased torque command value. If it exceeds the set speed range, control section 5 controls to drive image bearing member drive motor 110 by generating a PWM signal so as to have a decreased torque command value to maintain the speed within the set speed range. In such a way, transfer roller 10 is controlled to rotate at a constant speed.

Note that, as for the rotation speed of transfer roller 10, which is driven by transfer section drive roller 11 via transfer section driving belt 13, the above-mentioned constant speed may be set so as to have the same speed of intermediate transfer belt 1, or another constant speed may be set so as to have a faster speed by a predetermined value than the rotation speed of intermediate transfer belt 1. Note that, when transfer roller 10 is controlled under constant speed control, drive torque, at transfer section drive motor 110, is detected as a drive torque under constant speed. For the detection of drive torque under constant speed, a torque detector may be connected to transfer section drive motor 110, and the result of measurement of the torque detector is used. As the above-mentioned torque detector, there may be a torque detector which is intermediated between transfer section drive motor 110 and transfer section drive roller 11, and the drive torque under constant speed is obtained from the amount of twist, or the like. Also, in the case of the above-mentioned structure in which a PWM signal is used, torque detection can be carried out by analyzing the PWM signal itself which is a torque command on the occasion of constant speed control. Note that, in the torque detection, it is preferable to adopt a value with less fluctuation, as an example, but not limited to, an average value within a predetermined period of time. Note that the detecting time of drive torque under constant speed can be arbitrarily set if the detecting time is within a detectable time frame, and it is not necessary to detect the drive torque throughout the detectable time frame.

As described previously, the drive control in a state in which transfer section drive motor 10 is separated from intermediate transfer belt 1, has been described. Now, the drive control, in a state in which transfer section drive motor 10 is pressed into contact with intermediate transfer belt 1, will be described. In the state in which transfer section drive motor 10 is pressed into contact with intermediate transfer belt 1, constant torque control is carried out, in accordance with the drive torque under constant speed of transfer section drive motor 110, which is detected under constant speed control of transfer roller 10, so that the drive torque of transfer section drive motor 110 remains constant Although the torque value, in this case, may be equal to the torque value of the drive torque under constant speed, which has been detected during constant speed control, it is preferable to carry out constant torque control based on a larger torque value than constant speed drive torque, in consideration of fluctuation of drive torque when transfer section drive motor is rotating. Regarding that amplitude of the torque value, it may fit within the range of fluctuation of the above-mentioned drive torque. The range of fluctuation of the drive torque can be understood by collecting motion data of transfer section drive motor 110 in advance.

Besides the above, by making the speed of transfer roller 10 greater than the speed of intermediate transfer belt 1, in cases in which transfer roller 10 is controlled under constant speed control, as previously described, the drive torque under constant speed, to be detected at this time, may be determined as the torque value under constant torque control. The drive torque under constant speed, which is detected on this occasion, becomes a greater torque value than the torque value, which is detected when transfer roller 10 is controlled under constant speed control, so as to have the same speed of intermediate transfer belt 1. Herewith, constant torque control can be carried out based on the greater torque value than the torque value which is detected when transfer roller 10 is controlled under constant speed control. If the range of fluctuation of the above-mentioned drive torque can be set to fit within the difference between both the torque values of the cases, it can be controlled not to impose torque fluctuation onto intermediate transfer belt 1 even if fluctuation in the drive torque of transfer section drive motor 110 occurs. It is preferable to determine the rotation speed of transfer roller 10 based on this point, when transfer roller 10 is controlled under constant speed control at a faster speed than the speed of the intermediate transfer belt During constant torque control, transfer section drive motor 110 can be driven by generating a PWM signal corresponding to a predetermined torque value based on the relationship between the PWM signal and torque command. Since transfer section drive motor 110 is controlled under a constant torque, while constant torque control is carried out, even when a sheet is passed through the abutted part between transfer roller 10 and intermediate transfer belt 1, image formation can be carried out successfully without imposing torque fluctuation onto the side of intermediate transfer belt 1.

Figure 3:
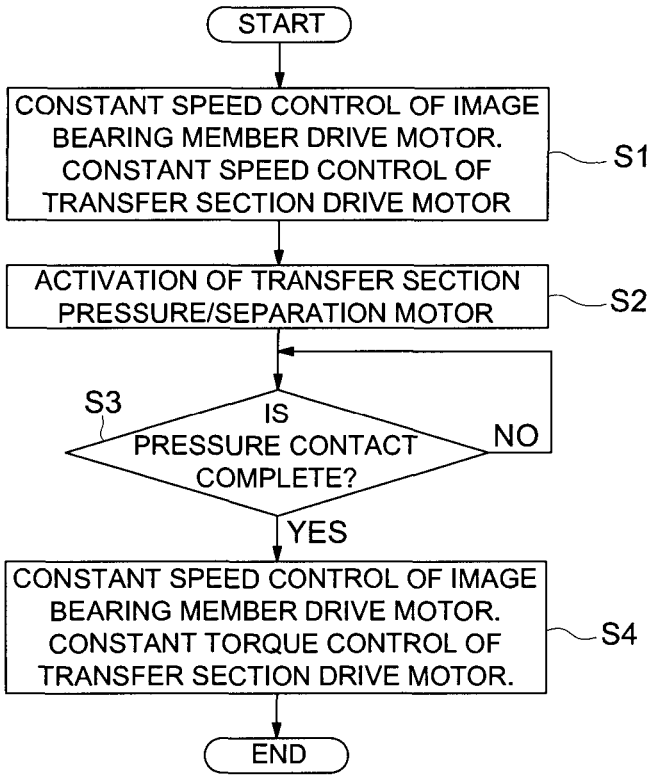
FIG. 3 is a flow chart showing steps of transfer section control according to an embodiment of the present invention.

Next, control steps of transfer roller 10 will be described on the basis of the flow chart shown in FIG. 3. First, in a state in which transfer roller 10 is separated from intermediate transfer belt 1, control section 5 controls to drive image bearing member drive motor 20 and transfer section drive motor 110 under a constant speed, via feedback of velocity information, so that the rotation speeds of transfer roller 10 and intermediate belt 1 stay at a constant speed as described above (step S1). At this time, control section 5 may control so that the rotation speeds of transfer roller 10 and intermediate transfer belt 1 become equal, and also, control section 5 may control so that the rotation speed of transfer roller 10 is faster than the rotation speed of intermediate transfer belt 1. Control section 5 detects the drive torque under constant speed of transfer section drive motor 110 based on the PWM signal while controlling to drive transfer section drive motor 110 under constant speed. An average torque value is calculated from the detected drive torque under constant speed. Regarding the determination of the torque value, in addition to the above, it may be determined based on a center value, or other appropriate methods, without the present invention being restricted by any particular method.

Next, transfer section pressure/separation motor 150 is activated so as to press transfer roller 10 into contact with intermediate transfer belt 1 (step S2). Along with completion of the pressure contact, the motion of transfer section pressure/separation motor 150 is terminated (step S3). When the pressure contact has been completed (step S3: YES), constant speed control of image bearing member drive motor 20 is continued for intermediate transfer belt 1, and, for transfer roller 10, constant torque control is carried out for transfer section drive motor 110, in accordance with the drive torque under constant speed, which is detected as described above (step S4). Note that, as described above, it is preferable to make the control torque value, under constant torque control, a greater value than the torque value of the above-mentioned drive torque under constant speed, which has been detected during constant speed control. Also, although it is not shown in FIG. 3, when transfer roller 10 is separated from intermediate from belt 1, constant torque control for transfer section drive motor 110 is changed to the above-mentioned constant speed control under constant speed.

Changing from the above-mentioned separation to pressure contact may be carried out, for example, but not limited to, along with initiation of image formation. Also, changing from pressure contact to separation may be carried out along with completion of a job or a reserve-job of image forming. Therefore, torque detection of the above-mentioned transfer section 110, and constant torque control of transfer section drive motor 110 in accordance with that detected torque, may be carried out, for example, but not limited to, each time when a series of jobs is complete and another series of jobs is initiated, and rotation control under an appropriate torque value can be carried out by regulating torque values under constant torque control. For example, even when a load torque at transfer section drive motor 110 fluctuates due to the abrasion of cleaning blade 14*a* of transfer section cleaning section, or the like, torque regulation, in accordance with that fluctuation, is carried out.

It has been explained that the control torque is detected along with completion and initiation of a series of jobs, and constant torque control of transfer section drive motor 110 is carried out in accordance with the detected torque. However, in cases in which the duration of a series of jobs is considerably long, for example, in a case that a series of jobs continues more than 10 hours, the risk of fluctuations of load torque is to be considered. Therefore, constant torque control of transfer section drive motor 110 can be carried out in such a manner that control section 5 controls to a) separate transfer roller 10 temporarily from intermediate transfer belt 1, b) detect drive torque under constant speed by controlling transfer section drive motor 110, which drives transfer roller 10, under constant speed, c) then, after the detection, press transfer roller 10 into contact with intermediate transfer belt 1 again, and d) carry out constant torque control of transfer section drive motor 110 via the torque which has been regulated based on the detected torque. In such a manner, it is possible to carry out appropriate control of transfer roller 10 in accordance with fluctuation of load torque even in cases in which jobs continue one after another.

Figure 4:
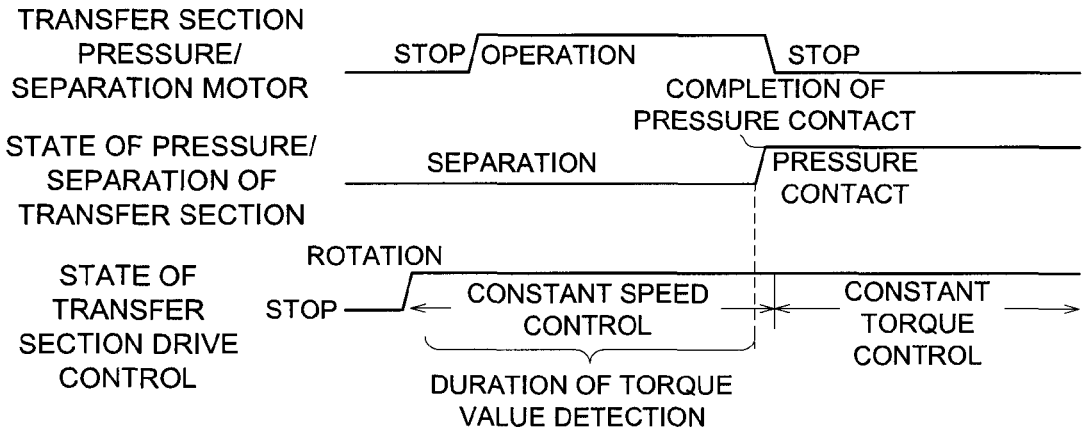
FIG. 4 is a timing chart of a transfer section according to an embodiment of the present invention.

Next, the timing in control of the above-mentioned transfer section will be described on the basis of the timing chart shown in FIG. 4. The upper chart shows the motion of transfer section pressure/separation motor 150. The center chart shows the state of pressure/separation of the transfer section, which state is detected by a sensor, or the like, and fed back to control section 5 from transfer section pressure/separation mechanism 15. The lower chart shows the state of control of transfer section drive motor 110, and shows the state of constant speed control and constant torque control when the transfer section is rotated or is stopped.

The state of control in which transfer section pressure/separation motor 150 is stopped and transfer section drive motor 110 is also stopped, is carried out in a stand-by state, or the like. In this state of control, transfer roller 10 is in a state of separation from intermediate transfer belt 1. The motion of transfer section drive motor 110 is initiated along with the motion to press transfer roller 10 into contact with intermediated transfer belt 1, and constant speed control is carried out under a constant speed when a steady state has been reached. Then, control section 5 activates transfer section pressure/separation motor 150 to move transfer roller 10 so as to press transfer roller 10 into contact with intermediate transfer belt 1.

Transfer roller 10 is moved to start contacting with intermediate transfer belt 1, and is moved until transfer roller 10 is pressed into contact with intermediate transfer roller 1 under a predetermined pressure. When transfer roller 10 is pressed into contact under a predetermined pressure with intermediate transfer belt 1, it reaches completion of pressure contact. When it reaches completion of pressure contact, the motion of transfer section pressure/separation motor 150 is stopped. When the motion of transfer section pressure/separation motor 150 is stopped, the control of transfer section drive motor 110 is switched from constant speed control to constant torque control. Note that the switching may be carried out at the same time as the above mentioned completion of pressure contact.

The above-mentioned constant speed control is carried out at transfer section drive motor 110, and during the time before transfer miler 10 starts contacting with intermediate transfer belt 1 (namely, in the state of complete separation), the drive torque under constant speed is detected, and the detected torque value is memorized in memory section 6. The torque value, to be used in constant torque control, is determined by adding a predetermined value to the torque value memorized in memory section 6, and constant torque control is carried out after completion of pressure contact of transfer roller 10. Note that, in cases in which torque value T, to be used in constant torque control, is determined, it is preferable to make torque value T in constant torque control larger than torque value TO which is detected in constant speed control, by, for example, but not limited to, an equation of T=T0+t (t>0), or T="k"×T0 ("k">0).

Note that, in the above, it has been described on the assumption that load at transfer section 10 is a constant. However, the mentioned load may vary in conjunction with pressure/separation of transfer roller 10. For examples, there are cases that, in the state in which transfer roller 10 is pressed into contact with intermediate transfer belt 1, cleaning blade 14*a* of transfer section cleaning section 14 is pressed into contact with transfer roller 10 under a predetermined normal pressure (normal pressure contact), and in the state in which transfer roller 10 is separated from intermediate transfer belt 1, cleaning blade 14*a* of transfer section cleaning section 14 is pressed into contact with transfer roller 10 under lighter pressure (light pressure contact) than the predetermined pressure in order to avoid abrasion of cleaning blade 14*a*. In such examples, it is needless to say that the load onto transfer section drive motor 110 becomes heavier in cases in which cleaning blade 14*a* is pressed into contact under the predetermined pressure, and becomes less in cases in which cleaning blade 14*a* is pressed into contact under lighter pressure.

Figure 5:
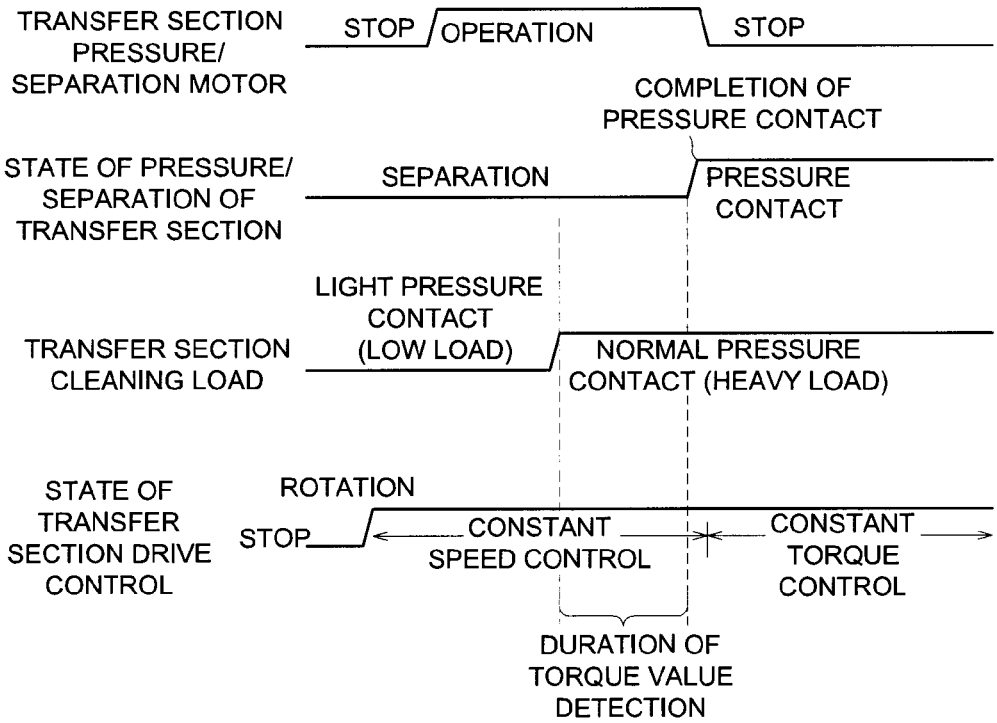
FIG. 5 is a variation of a timing chart of a transfer section according to an embodiment of the present invention.
Figure 6:
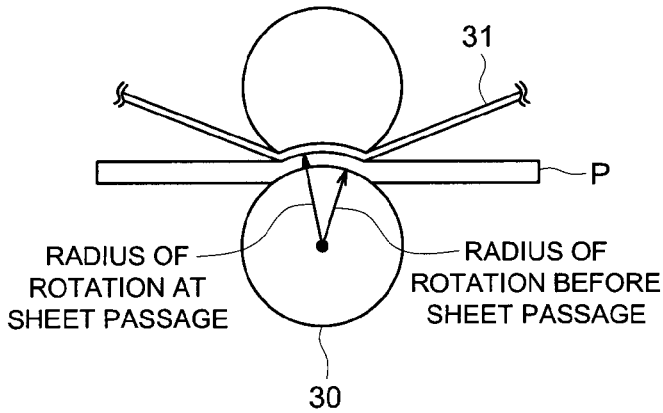
FIG. 6 is a diagram showing a state in which a sheet is passed through a part of pressure contact where a transfer section is pressed into contact with an intermediate transfer section.

In the above examples, when transfer roller 10 is pressed into contact with intermediate transfer belt 1, as shown in the timing chart shown in FIG. 5, the state of pressure contact of cleaning blade 14*a* is switched from the above-mentioned "light pressure contact" to "normal pressure contact" under a predetermined pressure before transfer roller 10 is pressed into contact with intermediate transfer belt 1, so that the functions of transfer section cleaning section 14 can be obtained immediately after transfer roller 10 is pressed into contact. This switching is carried out in the duration of the time when transfer section drive motor 110 is controlled under constant speed control. Then, during constant speed control, drive torque under constant speed, which is the basis of determination of torque value of constant speed control, is detected by the time when transfer roller 10 is started to be pressed into contact with intermediate transfer belt 1, after completion of the normal pressure contact under a predetermined pressure of transfer section cleaning section 14. If drive torque is detected before cleaning blade 14*a* is pressed into contact under the predetermined normal pressure, an appropriate torque value cannot be obtained. By detecting drive torque after cleaning blade 14*a* is pressed into contact under the predetermined normal pressure during constant speed control, torque value, in a state in which transfer roller 10 is pressed into contact with intermediate belt 1, can be determined accurately.

Note that the above explanations have been made on the assumption that the image bearing member is considered as an intermediate transfer belt. However, as an embodiment of the present invention, an image forming apparatus, in which intermediate transfer is not carried out, can be applied, and a similar effect can also be obtained in cases in which a transfer section is pressed into contact with a photoconductor as the image bearing member. Although the preferred embodiments of the present invention have been fully described by way of examples with reference to the accompanying drawings, it is to be noted that various changes and modifications will be apparent to those skilled in the art Therefore, unless such changes and modifications depart from the scope of the present invention, they are be construed as being included therein.

What is claimed is:

1. An image forming apparatus comprising:

an image bearing member for bearing a toner image;

a transfer section, which is pressed into contact with, and is separated from said image bearing member, for transferring a toner image borne on said image bearing member onto a recording medium at a time of being pressed into contact with said image bearing member;

a transfer section drive section for driving said transfer section to rotate;

a load member for varying a load onto said transfer section in conjunction with pressure contact and separation of said transfer section; and a control section configured to control said transfer section drive section to carry out a constant speed control, to drive said transfer section to rotate at a constant speed, and a constant torque control, to drive said transfer section to rotate at a constant torque, wherein said control section carries out said constant torque control under a state of pressure contact in which said transfer section is pressed into contact with said image bearing member, in accordance with a drive torque under constant speed, the drive torque that is detected when said constant speed control is carried out in a state of separation in which said transfer section is separated from said image bearing member, wherein said drive torque under constant speed is detected within a time frame in which said load member gives an amount of the load, onto said transfer section, during a time from said separation until said pressure contact.

2. The image forming apparatus described in claim 1, said transfer section comprising a pressure/separation section for carrying out an operation of pressure contact in which said transfer section is pressed into contact with said image bearing member, and an operation of separation in which said transfer section is separated from said image bearing member, wherein said control section is configured to control said operations of pressure contact and separation via said pressure/separation section.

3. The image forming apparatus described in claim 1, the apparatus further comprising a torque detection section for detecting said drive torque under constant speed.

4. The image forming apparatus described in claim 1, wherein said control section detects said drive torque under constant speed based on a drive command to said transfer section drive section during said constant speed control.

5. The image forming apparatus described in claim 1, wherein said drive torque under constant speed is detected in a state of separation shortly before said state of pressure contact when said transfer section is shifted from said state of separation to said state of pressure contact.

6. The image forming apparatus described in claim 1, wherein said control section carries out said constant torque control based on a torque value obtained by adding a predetermined value to said drive torque under constant speed.

7. The image forming apparatus described in claim 1, wherein said control section is configured to control a rotating speed of said transfer section to be a bigger circumferential speed than a circumferential speed of said image bearing member.

8. The image forming apparatus described in claim 1, the apparatus further comprising a memory section for memorizing said drive torque under constant speed, wherein said control section is configured to a) memorize said drive torque under constant speed which is detected during a time of said constant speed control, b) read out said drive torque under constant speed, having been memorized in said memory section, c) carry out said constant torque control in accordance with said drive torque under constant speed, having been memorized.

9. The image forming apparatus described in claim 1, wherein, in a state of pressure contact in which said transfer section is pressed into contact with said image bearing member, said control section is configured to a) temporarily separate said transfer section from said image bearing member in a state in which said transfer section is pressed into contact with said image bearing member, b) then, obtain a detected result of said drive torque under constant speed by carrying out said constant speed control, c) then, press said transfer section into contact with said image bearing member and also carry out an adjustment to control said transfer section drive section to carry out said constant torque control in accordance with said detected result.

10. The image forming apparatus described in claim 9, wherein said control section is configured to carry out said adjustment in a case in which said state of pressure contact of said transfer section exceeds a predetermined time.

11. The image forming apparatus described in claim 1, the apparatus further comprising an image bearing member drive section for driving said image bearing member to rotate, wherein said control section is configured to control said image bearing member drive section to carry out a constant speed control to drive said image bearing member to rotate at a constant speed.

12. The image forming apparatus described in claim 1, wherein the amount of the load is a same amount of load, onto said transfer section that said load member gives at the time of said state of pressure contact.

13. An image forming method comprising:

detecting a drive torque, in a state in which a transfer section, which is pressed into contact with, and is separated from an image bearing member which bears a toner image, is separated from said image bearing member, while controlling a drive section, which drives said transfer section to rotate, to carry out a constant speed control to drive said transfer section to rotate at a constant speed and a load giving member, which varies a load onto a transfer section in conjunction with pressure contact and separation of said transfer section, to give an amount of the load onto said transfer section, during a time from said separation until said pressure contact; and carrying out a constant torque control in a state in which said transfer section is pressed into contact with said image bearing member, in accordance with said drive torque.

14. The image forming method described in claim 13, wherein the amount of the load is a same amount of load onto said transfer section that said load member gives at a time of said state of pressure contact.

* * * * *